US009062454B1

(12) United States Patent
Borgman et al.

(10) Patent No.: US 9,062,454 B1
(45) Date of Patent: Jun. 23, 2015

(54) DUAL VENTILATION PROCESS

(75) Inventors: Paul Borgman, Louisville, KY (US); Todd Prosan, Knoxville, TN (US)

(73) Assignee: Blue Canyon Solutions, LLC, Louisville, KY (US)

( * ) Notice: Subject to any disclaimer, the term of this patent is extended or adjusted under 35 U.S.C. 154(b) by 1547 days.

(21) Appl. No.: 11/961,627

(22) Filed: Dec. 20, 2007

Related U.S. Application Data

(63) Continuation-in-part of application No. 11/627,140, filed on Jan. 25, 2007.

(60) Provisional application No. 60/868,527, filed on Dec. 2, 2006.

(51) Int. Cl.
*E04B 1/70* (2006.01)
*F24F 7/02* (2006.01)
*F24F 7/06* (2006.01)

(52) U.S. Cl.
CPC ..... *E04B 1/7023* (2013.01); *F24F 7/025* (2013.01); *F24F 7/06* (2013.01)

(58) Field of Classification Search
USPC ..... 454/341–345, 909; 52/169.5; 137/312; 134/18
IPC . F24F 7/025,7/007; E02D 31/02; E04B 1/7023; B08B 3/02
See application file for complete search history.

(56) References Cited

U.S. PATENT DOCUMENTS 4,612,742 A 9/1986 Bevilacqua
4,798,034 A 1/1989 Jarnagin et al.
4,858,521 A 8/1989 Heh
4,878,421 A 11/1989 Glasser
4,885,984 A 12/1989 Franceus
4,905,579 A * 3/1990 Dame ..... 454/238
4,922,808 A 5/1990 Smith
4,930,272 A 6/1990 Bevilacqua
4,949,626 A 8/1990 Townsend et al.
4,957,394 A 9/1990 Jarnagin et al.
4,988,237 A 1/1991 Crawshaw
4,995,309 A 2/1991 Weaver
5,035,095 A 7/1991 Bevilacqua
5,083,500 A 1/1992 Francis et al.
5,101,712 A 4/1992 Dean, Jr.
5,127,768 A 7/1992 Crawshaw et al.
5,158,501 A 10/1992 Proskiw
5,186,160 A 2/1993 Klein, II
5,191,874 A 3/1993 McWilliams
5,277,003 A * 1/1994 Myers ..... 52/169.5
5,288,268 A 2/1994 Kuypers
5,403,234 A * 4/1995 Kuypers ..... 454/345
5,474,400 A 12/1995 Kliefoth et al.
5,551,797 A 9/1996 Sanford
5,660,008 A 8/1997 Bevilacqua
5,765,323 A 6/1998 Bevilacqua
5,836,815 A 11/1998 Jennemann
6,202,700 B1 3/2001 Bevilacqua (Continued)

*Primary Examiner* — Steven B McAllister
*Assistant Examiner* — Helena Kosanovic
(74) *Attorney, Agent, or Firm* — Middleton Reutlinger

(57) ABSTRACT

A dual ventilation system is provided for a structure. The system has a suction tube assembly with an exhaust outlet in an upper end thereof and an exhaust fan therein. An intake vent or other intake means is in a lower portion of the structure in flow communication with the suction tube assembly. At least one channel is proximate a lower portion of the structure in flow communication with at least one lower interior portion of an exterior wall of the structure and in flow communication with the suction tube. In structures having a sump pump, the sump pump liner is in flow communication with the channel.

14 Claims, 13 Drawing Sheets

(56) References Cited

U.S. PATENT DOCUMENTS

| | | | | |
|---|---|---|---|---|
| 6,467,995 | B2 | 10/2002 | Bevilacqua et al. | |
| 6,468,054 | B1 | 10/2002 | Anthony et al. | |
| 6,524,182 | B2 | 2/2003 | Kilburn et al. | |
| 6,527,005 | B2 | 3/2003 | Weaver | |
| 6,575,666 | B1 | 6/2003 | Janesky | |
| 6,739,800 | B2 | 5/2004 | Bevilacqua | |
| 6,891,284 | B2 | 5/2005 | Tilley | |
| 6,904,723 | B1 * | 6/2005 | Moore et al. | 52/169.5 |

* cited by examiner

DUAL VENTILATION PROCESS

CROSS-REFERENCE TO RELATED APPLICATION

This application is a continuation-in-part of and claims priority to, and benefit from, U.S. Non-Provisional patent application Ser. No. 11/627,140, filed on Jan. 25, 2007, entitled "Dual Ventilation System", which is currently pending, which claims priority to provisional Patent Application No. 60/868,527, filed on Dec. 2, 2006.

STATEMENT REGARDING FEDERALLY SPONSORED RESEARCH OR DEVELOPMENT

Not applicable.

FIELD OF INVENTION

The present invention relates to a ventilation system for the mitigation of water, moisture, gases, and biological as well as physical agents entering a structure.

BACKGROUND OF THE INVENTION

Water, moisture, odors, radon, organics, and various environmental pollutants or toxins in the form of liquids, gases, and particulates enter building structures through several entry mechanisms. These harmful and/or unpleasant substances may enter the structure by penetrating basement walls and slab materials through small pores, openings and cracks in the walls or slab or even by capillary action through a solid wall or slab to diffuse into the useable or living space of the structure.

There are many sources and environmental conditions permitting water and harmful and/or unpleasant substances to affect a structure, such as surface water, saturated ground water, high water table, outgassing, tunnels built by animals, clogged gutters, nearby construction, wet weather, springs, tree roots, exterior humidity condensing on cooler surfaces, as well as shrinking and swelling of the soil. There are several ways water and other substances may enter a basement or lower portion of a structure such as bleeding and sweating of the walls, entering through wall cracks and mortar joints, and entering over as well as under the footing, and through cracks in the floor. Water can collect at a buildings foundation causing moisture to enter the building through capillary action. Water can also cause structural damage. Standing water inside hollow cores in masonary block walls allows slack acid to form undermining the foundation by deteriorating the block walls.

Lesser amounts of water or moisture enter the structure causing the inhabitable space within the structure to have an unpleasant damp or musty odor. In addition to the previously stated sources, there are interior sources of moisture such as humidifiers, unvented clothes dryers, bathrooms, kitchens, and moisture in the concrete adding to the moisture inside the structure. Conditions compounding the build up of moisture in the structure are structures that are sealed tight for energy efficiency, tight fitting windows and doors, and other conditions that stagnate the air in the structure. Stagnant air can cause a build up of moisture as well as indoor pollutants, disease-causing toxins, infectious organisms, gases such as radon, odors, humidity, allergens, mold toxins, and pet dander, in a structure. Additionally, moisture in the basement or lower area of the structure can result in damage to the foundation and lower part of the structure and the formation of mold in building materials, carpets and furnishings. Molds have been found to produce objectionable odors, allergic reactions, and even illnesses and possibly compromise the immune system. Moisture can also attract spiders, silverfish, centipedes, and other such pests.

Pollutants known to enter basements and lower areas of a structure include radioactive radon gas and its progeny. These radionuclides emit the alpha radiation which can cause lung cancers. Other known pollutants to enter the structure include waste materials, lawn fertilizers, herbicides, pesticides, methane and other gases, natural organic content of the soil from decaying matter, bacteria, soil fungal propagules, funguses, and outgasses. These harmful and/or unpleasant substances enter a structure by several mechanisms. Sump pumps, floor drains, cracks, and service openings typically provide a path of direct entry into the lower portion of a structure.

Various systems have been employed in an attempt to reduce or prevent the entry of water, moisture, and pollutants into building structures. Dehumidifiers, aeronizers, and air filtration systems have had limited success in specific areas of a structure but have failed to completely mitigate the problems and require frequent maintenance, make noise, and take up floor space. Correcting basement concrete wall cracking and leakage is probably the most common and costly repair made to structures in an attempt to mitigate water and pollutant problems. These have included plugging cracks in foundation slabs and basement walls, and sealing and venting sump pumps and other such openings. However, these fixes alone have been found to only mitigate the water for a specific period of time and have limited or little effect on the moisture and pollutants entering the structure. With such an ad hoc preventative approach it is virtually impossible to permanently seal all cracks, and thus, the entry of soil pollutants or foundation water by this mechanism is not fully and permanently abated.

The natural stack effect of a structure has been used by drawing in cooler outside air through openings in the structure below the neutral pressure zone of the structure and exhausting the warmed inside air from an upper portion of the structure. This buoyancy-induced stack effect does not work when it is too hot outside. The air pressure of the basement area is generally at a lesser air pressure than that of the external soil air causing soil gases to be drawn into any openings such as basement or foundation cracks into the building structure.

Other systems have also been tried, but these have also been found to be problematic. These include exhausting a weeping tile to the outdoor air so as to depressurize around the slab wall interface so that any soil gases may escape to the atmosphere without entering the lower portion of the structure. However, this approach does not deal with water leakage and condensation problems and fails to mitigate indoor moisture or pollutants that have entered the structure. Additionally, weeping tile can become plugged and the layer of gravel may not allow free air movement to the exhaust. Further, since moisture and entrained gases can travel through the concrete by capillary action and mass diffusion, only partial mitigation is achieved.

BRIEF DESCRIPTION OF THE DRAWING

Reference to the figures discloses embodiments of a dual ventilation system and is not to be interpreted as limiting the scope of the present invention as other systems will become apparent by persons having ordinary skill in the art upon reading the instant disclosure.

DETAILED DESCRIPTION

The instant invention provides for dual ventilation of a structure. Substructure ventilation is provided by creating a vacuum or negative pressure within channels proximate an interior side of footers. The channels, i.e. pipes, have holes on an exterior side in flow communication with an interior portion of exterior walls of the structure via weep holes on an internal lower side of the exterior walls. The channels are also in flow communication with a suction tube having an exhaust fan therein and terminating with an exhaust vent to the exterior of the structure. Additionally, an intake vent having an opening in a lower portion of the structure is in flow communication with the suction tube providing turnover of air within the structure. The system is provided for structures having a crawlspace, basement, or daylight basement and is adaptable to existing structures and can be incorporated into new construction. The ventilation system may be incorporated with a sump pump and/or other water, moisture, or gas mitigation systems.

Figure 1A:
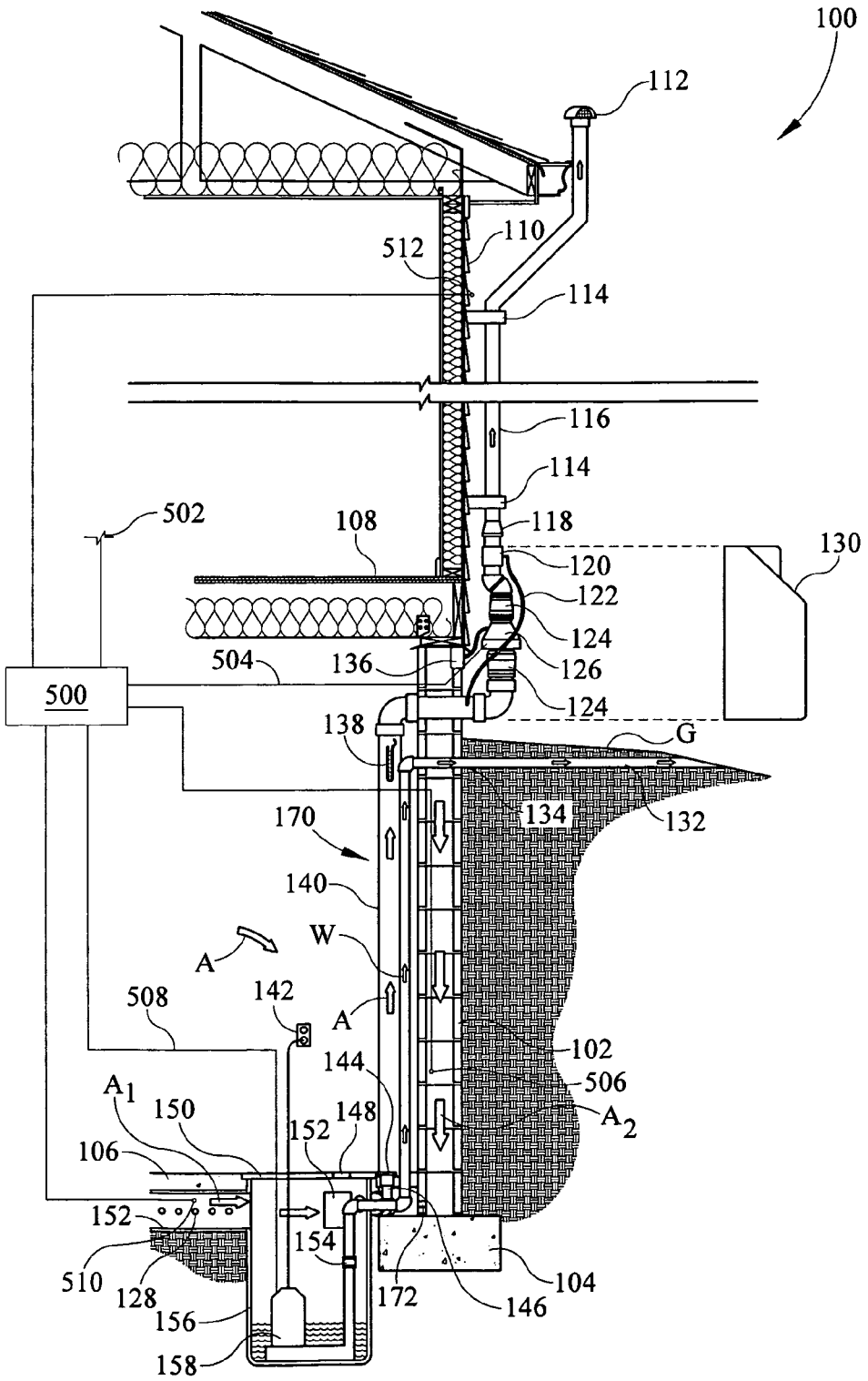
FIG. 1A is a cross-sectional view showing an embodiment of a ventilation system for an existing structure having a basement and an embodiment of a process control system.

FIG. 1A shows basement ventilation system 100 designed for an existing structure. Basement wall 102 rests on footer 104 and extends upward supporting the first floor 108 of the structure. Submersible sump pump 158 rests in a bottom portion of sump liner 156. Sump pump 158 pumps water 'W' collected within sump liner 156 upward and outward away from the structure through water discharge pipe 132 having check valve 154. Water discharge pipe 132 is preferably sealed where it passes through the exterior side of basement wall 102 with caulk 134, preventing water, moisture, and gases from entering into basement wall 102 around discharge pipe 132. The discharge point of discharge pipe 132 is located at grade 'G' sloping away from the structure, however it is to be understood that discharge pipe 132 may tie into existing drainage systems. Sump liner 156 has sump cover 150 with optional view port 148 sealing the top opening thereof and being substantially flush with basement slab 106. View port 148 provides for visually monitoring the depth of water within sump liner 156 and checking the working status of sump pump 158. Channel 152 having holes 128 on an exterior side thereof circumscribes the internal side of basement wall 102 below and proximate basement slab 106 and connects into an upper portion of sump liner 156. In this embodiment, channel 152 is in the form of a rectangular channel or pipe. However, it is to be understood than any channel forming material having any cross-sectional configuration may provide the desired flow communication. For example, a round pipe having holes, perforated conduit, or even a gutter with holes below a top surface of slab 106 may provide the desired flow communication. Sump pump 158 is in electrical communication with power supply 142. Suction tube 140 is a part of suction tube assembly 170 that is maintained under negative pressure with exhaust fan 126. Preferably, exhaust fan 126 is sized to remove at least six times the volume of the air in the structure per day and more preferably can remove up to ten times the volume of the air in the structure per day. Exhaust fan 126 is intended to continuously run. Suction tube 140 joins into an upper portion of sump liner 156 and has air intake vent 144 joined thereto with air intake vent pipe 146. Air intake vent 144 is substantially flush with basement slab 106 and provides for continuous ventilation, as shown with arrow 'A', of the basement, keeping the basement under negative pressure. The makeup air is provided by the upper floors of the structure through vents, stairwells, through the hollow portion of exterior walls, or other air passage ways providing a full turnover of air throughout the interior space of the structure and the interior portion of exterior block walls. The negative pressure created within sump liner 156 pulls air '$A_1$' through holes 128 into channel 152, creating negative pressure within channels 152. Channels 152 are in flow communication with the interior portion of basement wall 102 via weep holes 172 pulling air '$A_2$' therethrough and creating negative pressure within basement wall 102. Any water or moisture that may enter channel 152 flows into sump liner 156. Suction tube assembly 170 optionally has manometer 138 monitoring the pressure differential between suction tube 140 and the outside ambient air providing an indicator of the pressure differential therebetween or its operational status. Suction tube assembly 170 passes through basement wall 102 and continues vertically upward where flexible couplings 124 join each end of exhaust fan 126 into suction tube assembly 170. Exhaust fan 126 is in electrical communication with electrical disconnect 136. Above exhaust fan 126 is condensation collar 120 having condensation tube 122 depending therefrom. Condensation tube 122 carries condensate flowing down the inside of suction tube assembly 170 into suction tube 140 below exhaust fan 126 protecting exhaust fan 126 from water damage. This condensate is carried down suction tube 140 into sump liner 156 where it is pumped to grade 'G'. Fan 126, flexible couplings 124, condensate collar 120, and condensation tube 122, are optionally housed within fan cover 130. Typically, suction tube assembly 170 is comprised of round PVC pipe below condensation collar 120. It may be advantageous for suction tube assembly 170 to be comprised of metal downspout above condensation collar 120. Therefore, optional PVC round to metal downspout adaptor 118 may be incorporated within suction tube assembly 170 wherein metal downspout 116 depends upward therefrom. However it is to be understood that suction tube assembly 170 may be comprised of metal, PVC, both metal and PVC, or other materials. Brackets 114 may be necessary to support suction tube assembly 170 to the exterior surface of the building 110. Suction tube assembly 170 terminates with exhaust vent 112 which preferably exhausts at an upper portion of the building taking advantage of additional vacuum created within suction tube assembly 170 from outdoor air flowing thereby.

Also shown in FIG. 1A is a process control system that may optionally be incorporated into the dual ventilation system and method. The process control system comprises a process control unit 500 in electrical communication with a switch controlling exhaust fan 126 and at least one humidity sensor 510, 512, and/or 512. Humidity sensor 506 is located within a void space of outer wall 102, humidity sensor 512 is shown located in outside ambient air, and humidity sensor 510 is located within channel 152. Process control unit 500 advantageously has a humidity variable stored within and compares the humidity from one or more humidity sensor 510, 512, and/or 512 and switches on exhaust fan 126 when the sensed humidity is below the humidity variable stored within process control unit 500. Alternatively, process control unit 500 may compare the humidity between sensors and switch on fan 126 when a programmed difference between the values is obtained. For example, process control unit 500 may be set to switch on fan 126 when the humidity sensed with sensor 510 in channel 152 is a set amount above the humidity sensed with sensor 512 in outside ambient air. As can be appreciated by one skilled in the art, a wide variety of humidity data can be gathered with process control unit 500 and a wide variety of comparisons and calculations can be made to optimize the switching of fan 126 on and off to maximize ventilation of a structure. Additionally, process control unit 500 may be in electrical communication with sump pump 158 through electrical connection 508 and incorporate a test system capable of testing sump pump 158 on a specific test cycle by sending an electronic signal to sump pump 158 through electrical connection 508. This optional functionality improves the probability that sump pump 158 will work during a rain event. Furthermore, process control unit 500 may optionally be in electrical connection with an ISP or other communication service such as telephonic at junction 502 wherein one may be notified in the event sump pump 158 fails a test cycle or any of the system parameters are out of upper and/or lower control limits set in process control unit 500.

Figure 1B:
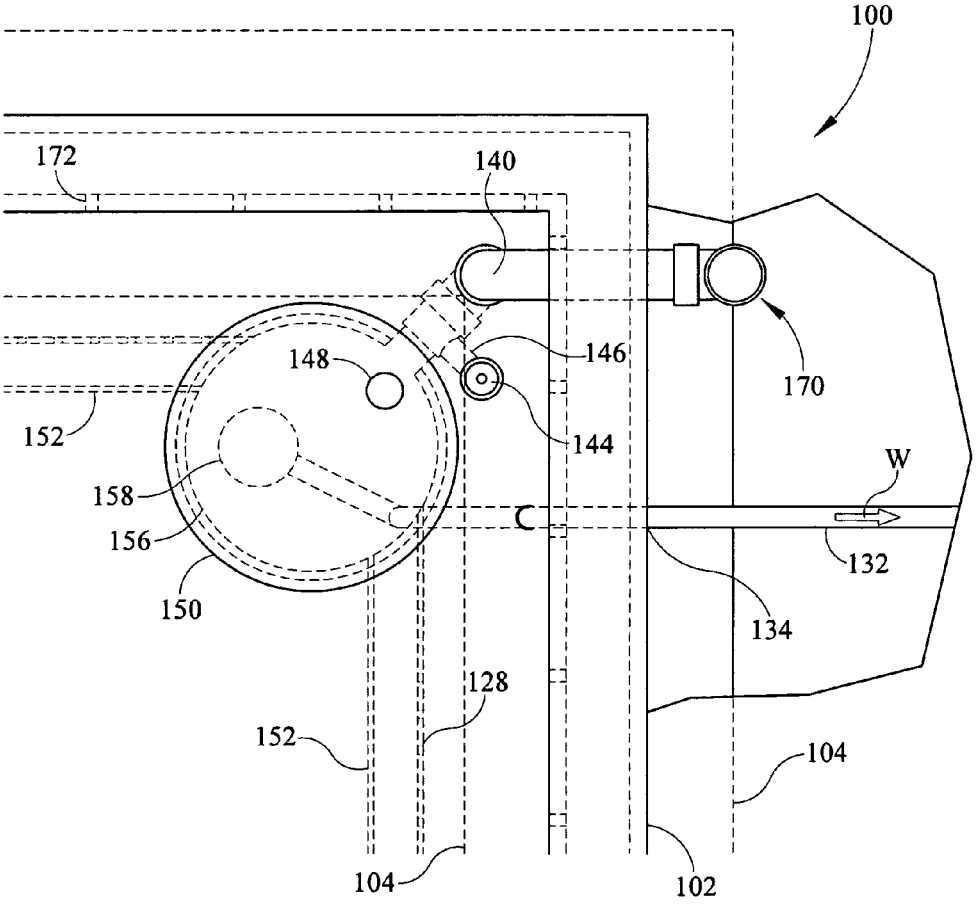
FIG. 1B is a top detailed view of an embodiment of the sump, water, and air pipes of a ventilation system for an existing structure having a basement.

FIG. 1B shows a top detailed view of basement ventilation system 100 having intake vent 144 proximate sump pump 158. Basement wall 102 rests on footer 104 and extends upward therefrom. Submersible sump pump 158 rests in a bottom portion of sump liner 156 and has suction tube assembly 170 in flow communication therewith. Sump pump 158 pumps water 'W' collected within sump liner 156 upward and outward away from the structure through water discharge pipe 132. Water discharge pipe 132 is sealed where it passes through the exterior side of basement wall 102 with caulk 134. Sump liner 156 has sump cover 150 with view port 148 sealing the top opening thereof. Channel 152 having holes 128 in flow communication with weep holes 172 circumscribes the internal side of basement wall 102 and connects into an upper portion of sump liner 156, thus keeping sump liner 156 and the internal portion of wall 102 under negative pressure. Suction tube assembly 170 has suction tube 140 joining into an upper portion of sump liner 156 and has air intake vent 144 joined thereto with air intake vent pipe 146.

Figure 2A:
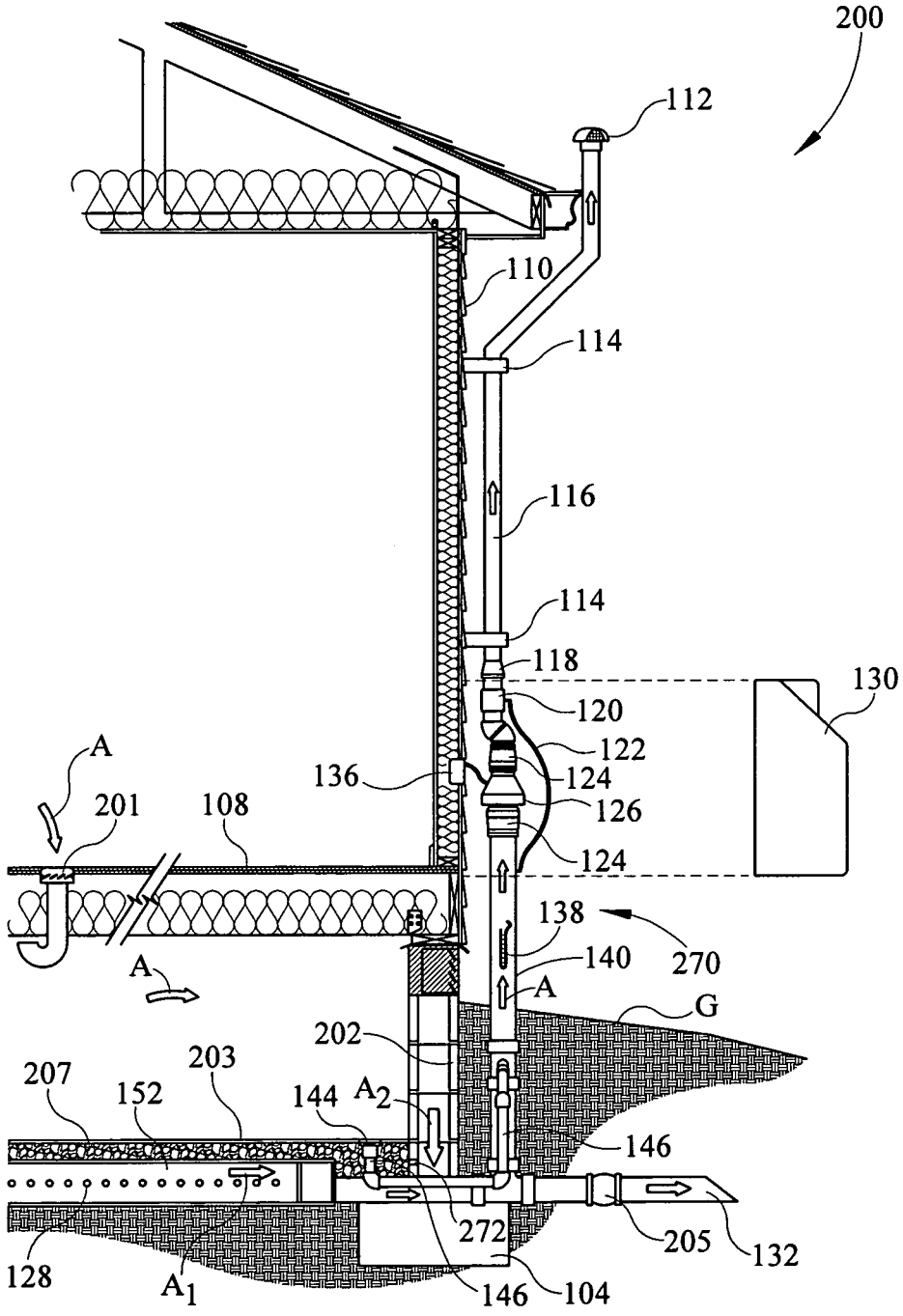
FIG. 2A is a cross-sectional view of an embodiment of a ventilation system for new construction of a structure having a crawlspace with gravity flow.

FIG. 2A shows crawlspace ventilation system 200 designed for incorporation with new construction having a gravity flow system. Crawlspace wall 202 rests on footer 104 and extends upward supporting the first floor 108 of the structure. Water discharge pipe 132 having check valve 205 extends downward and outward away from the structure. Channel 152 having holes 128 circumscribes the internal side of crawlspace wall 202 below gravel 207. Above gravel 207 is vapor barrier 203. Suction tube 140 is a part of suction tube assembly 270 and is maintained under negative pressure with exhaust fan 126. Suction tube 140 joins into channel 152 and has air intake vent 144 joined thereto with air intake vent pipe 146. Air intake vent 144 is substantially flush with vapor barrier 203 and provides for continuous ventilation, as shown with arrow '$A_1$', of the crawlspace keeping the crawlspace under negative pressure. Channel 152 pulls air '$A_2$' through holes 128 into channel 152, creating negative pressure within channels 152 and about the perimeter of the structure. Channels 152 are in flow communication with the interior portion of crawlspace wall 202 via weep holes 272 pulling air '$A_3$' therethrough and creating negative pressure within crawlspace wall 202. Suction tube assembly 270 has manometer 138 monitoring the pressure differential between suction tube 140 and the ambient air providing an indicator of negative pressure. Suction tube assembly 270 passes through crawlspace wall 202 and continues vertically upward where flexible couplings 124 join each end of exhaust fan 126 into suction tube assembly 270. Exhaust fan 126 is in electrical communication with electrical disconnect 136. Above exhaust fan 126 is condensation collar 120 having condensation tube 122 depending therefrom. Condensation tube 122 carries condensate flowing down tube assembly 270 into a lower portion of suction tube assembly 270 below exhaust fan 126, suction tube 140. This condensate travels down suction tube 140 into water discharge pipe 132. Fan 126, flexible couplings 124, condensate collar 129, and condensation tube 122, are optionally housed within fan cover 130. Typically, suction tube assembly 270 is comprised of round PVC pipe below condensation collar 120. It may be advantageous for suction tube assembly 270 to be comprised of metal downspout above condensation collar 120. Therefore, optional PVC round to metal downspout adaptor 118 may be incorporated within suction tube assembly 270 wherein metal downspout 116 depends upward therefrom. However it is to be understood that suction tube assembly 270 may be comprised of metal, PVC, both metal and PVC, or other materials. Brackets 114 may be necessary to support suction tube assembly 270 to the exterior surface of the building 110. Suction tube assembly 270 terminates with exhaust vent 112 which preferably exhausts at an upper portion of the building. 'J' pipe 201 is an indoor air return with a dampener that draws air '$A_3$' from the interior of the structure into the crawlspace providing turnover of air throughout the structure.

Figure 2B:
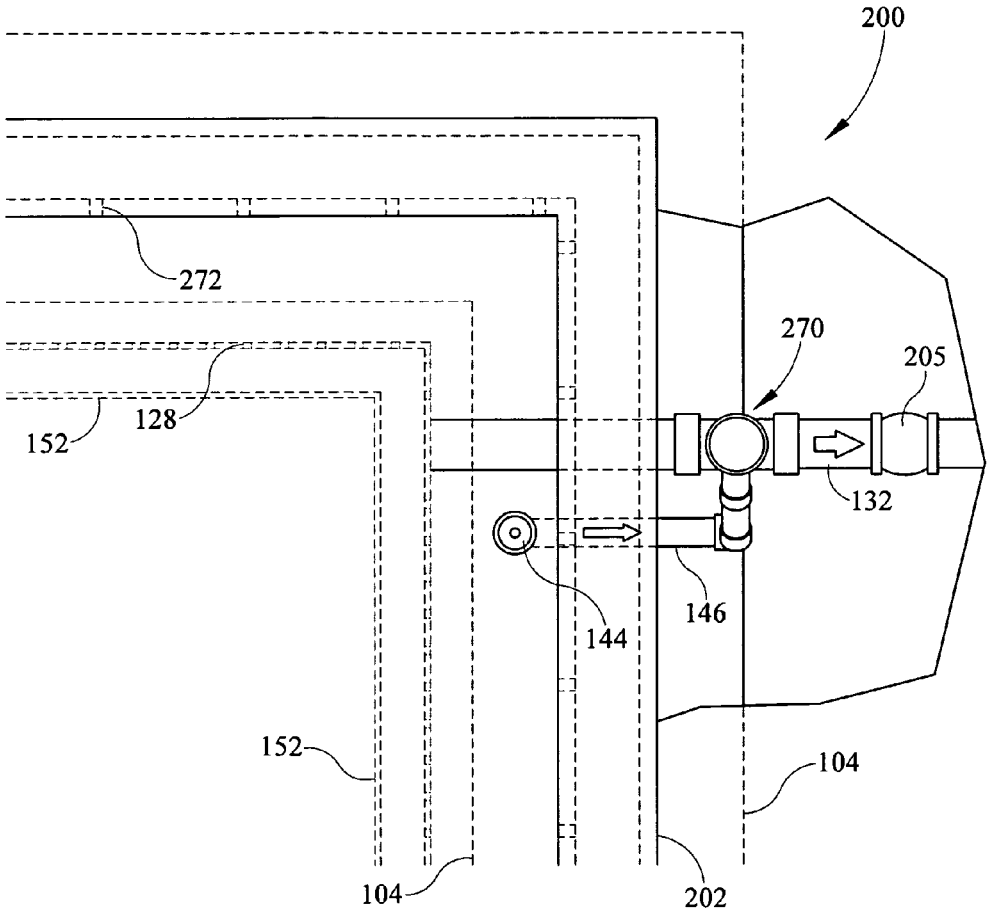
FIG. 2B is a top detailed view of an embodiment of the water and air pipes of a ventilation system for new construction of a structure having a crawlspace with gravity flow.

FIG. 2B shows a top detailed view of crawlspace ventilation system 200. Crawlspace wall 202 rests on footer 104 and extends upward therefrom. Channel 152 having holes 128 in flow communication with crawlspace weep holes 272 circumscribes the internal side of crawlspace wall 202 and connects with water discharge pipe 132. Water discharge pipe 132 has check valve 205 preventing backflow of water into channel 152. Suction tube assembly 270 is maintained under negative pressure and joins into water discharge pipe 132 and has air intake vent 144 joined thereto with air intake vent pipe 146.

Figure 3A:
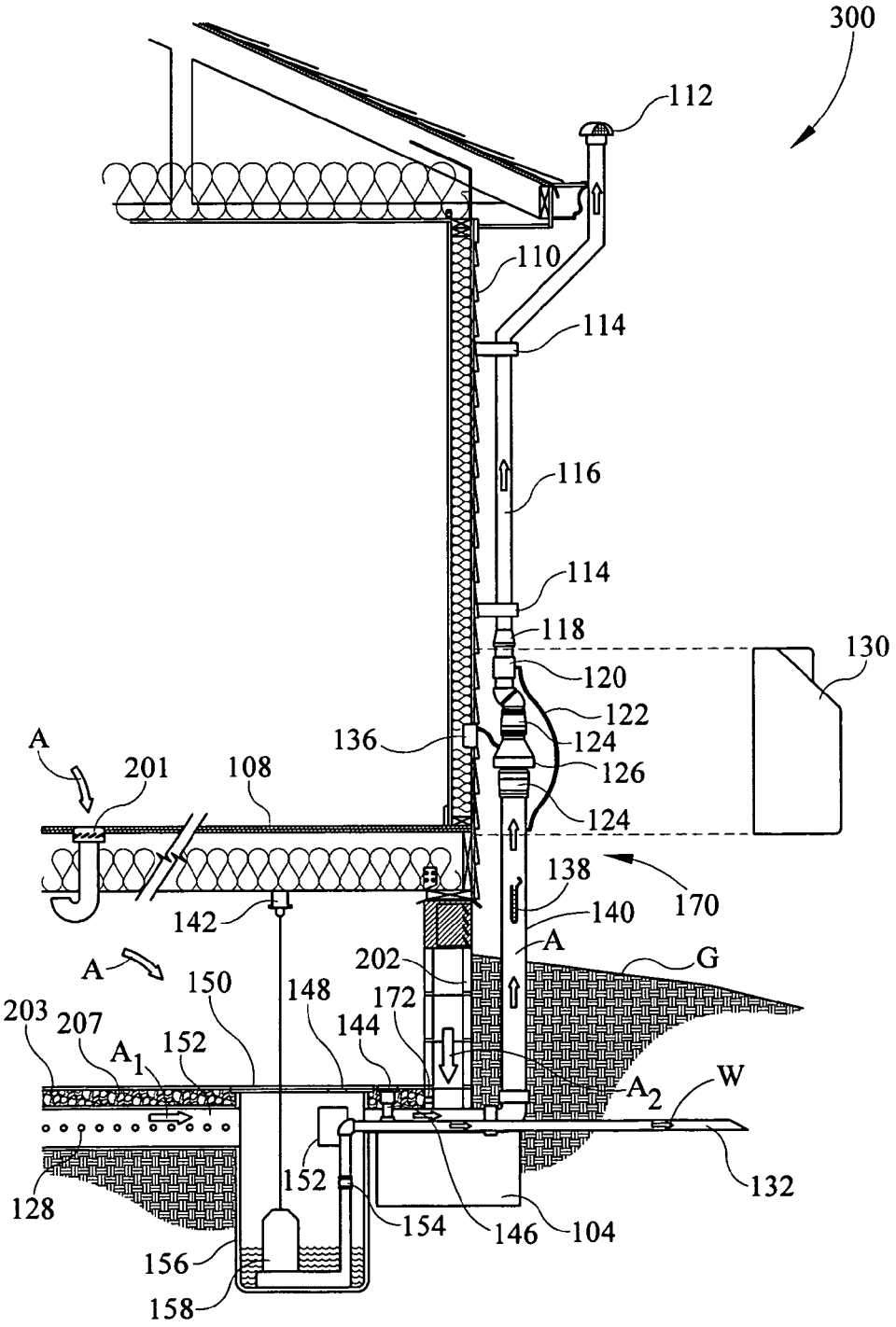
FIG. 3A is a cross-sectional view of an embodiment of a ventilation system for new construction of a structure having a crawlspace.

FIG. 3A shows ventilation system 300 for new construction of a structure having a crawlspace. Crawlspace wall 202 rests on footer 104 and extends upward supporting the first floor 108 of the structure. The floor of the crawlspace is comprised of gravel 207 covered with vapor barrier 203. Submersible sump pump 158 rests in a bottom portion of sump liner 156. Sump pump 158 pumps water 'W' collected within sump liner 156 upward and outward away from the structure through water discharge pipe 132 having check valve 154. Sump liner 156 has sump cover 150 with optional view port 148 sealing the top opening thereof and being substantially flush with vapor barrier 203. View port 148 provides for visually monitoring the depth of water within sump liner 156 and checking the working status of sump pump 158. Channel 152 having holes 128 circumscribe the internal side of crawlspace wall 202 below and proximate gravel 207 and connects into an upper portion of sump liner 156. Sump pump 158 is in electrical communication with power supply 142. Suction tube 140 is a part of suction tube assembly 170 is maintained under negative pressure with exhaust fan 126. Suction tube 140 joins into an upper portion of sump liner 156 and has air intake vent 144 joined thereto with air intake vent pipe 146. Air intake vent 144 is substantially flush with vapor barrier 203 and provides for continuous ventilation, as shown with arrow 'A', of the crawlspace, keeping the crawlspace under negative pressure. The negative pressure created within sump liner 156 pulls air '$A_1$' through holes 128 into channel 152, creating negative pressure within channels 152. Channels 152 are in flow communication with the interior portion of crawlspace wall 202 via weep holes 172 pulling air '$A_2$' therethrough and creating negative pressure within crawlspace wall 202. Any water or moisture that may enter channel 152 flows into sump liner 156. Suction tube assembly 170 optionally has manometer 138 monitoring the pressure differential between suction tube 140 and ambient air providing an indicator of the pressure differential therebetween. Flexible couplings 124 join each end of exhaust fan 126 into suction tube assembly 170. Exhaust fan 126 is in electrical communication with electrical disconnect 136. Above exhaust fan 126 is condensation collar 120 having condensation tube 122 depending therefrom. Condensation tube 122 carries condensate flowing down the outer side of tube assembly 170 into a lower portion of suction tube assembly 170 below exhaust fan 126. This condensate is carried down suction tube 140 into sump liner 156 where it is pumped out water discharge pipe 132. Fan 126, flexible couplings 124, condensate collar 120, and condensation tube 122, are optionally housed within fan cover 130. Typically, suction tube assembly 170 is comprised of round PVC pipe below condensation collar 120. It may be advantageous for suction tube assembly 170 to be comprised of metal downspout above condensation collar 120. Therefore, optional PVC round to metal downspout adaptor 118 may be incorporated within suction tube assembly 170 wherein metal downspout 116 depends upward therefrom. However it is to be understood that suction tube assembly 170 may be comprised of metal, PVC, both metal and PVC, or other materials. Brackets 114 may be necessary to support suction tube assembly 170 to the exterior surface of the building 110. Suction tube assembly 170 terminates with exhaust vent 112 which preferably exhausts at an upper portion of the building taking advantage of additional vacuum created within suction tube assembly 170 from outdoor air flowing thereby. 'J' pipe 201 is an indoor air return with a dampener that draws air '$A_3$' from the interior of the structure into the crawlspace.

Figure 3B:
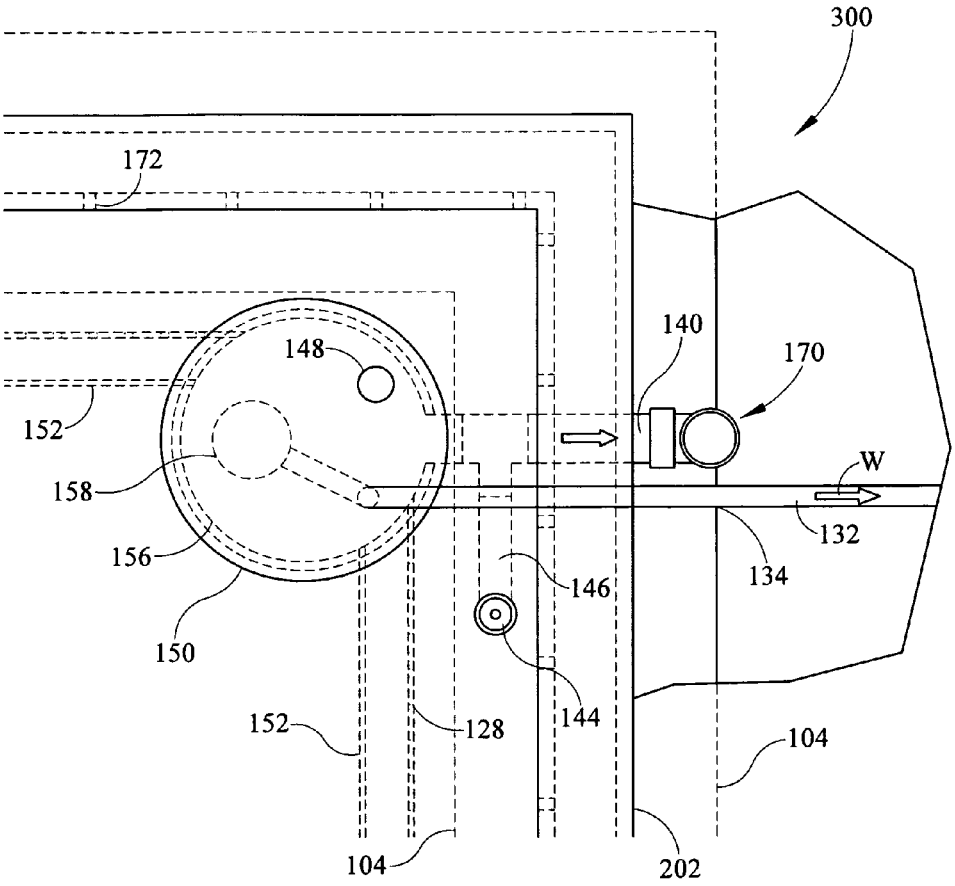
FIG. 3B is a top detailed view of an embodiment of the sump, water and air pipes of a ventilation system for new construction of a structure having a crawlspace.

FIG. 3B shows a top detailed view of crawlspace ventilation system 300. Crawlspace wall 202 rests on footer 104 and extends upward therefrom. Submersible sump pump 158 rests in a bottom portion of sump liner 156 and has suction tube assembly 170 in flow communication therewith. Sump pump 158 pumps water 'W' collected within sump liner 156 upward and outward away from the structure through water discharge pipe 132. Sump liner 156 has sump cover 150 with view port 148 sealing the top opening thereof. Channel 152 having holes 128 in flow communication with weep holes 172 circumscribes the internal side of crawlspace wall 202 and connects into an upper portion of sump liner 156 thus keeping sump liner 156 and the internal portion of wall 202 under negative pressure. Suction tube assembly 170 joins into an upper portion of sump liner 156 and has air intake vent 144 joined thereto with air intake vent pipe 146. In this embodiment, air intake vent pipe 146 becomes into flow communication with suction tube assembly 170 at suction tube 140 prior to passing through exterior wall 172.

Figure 4:
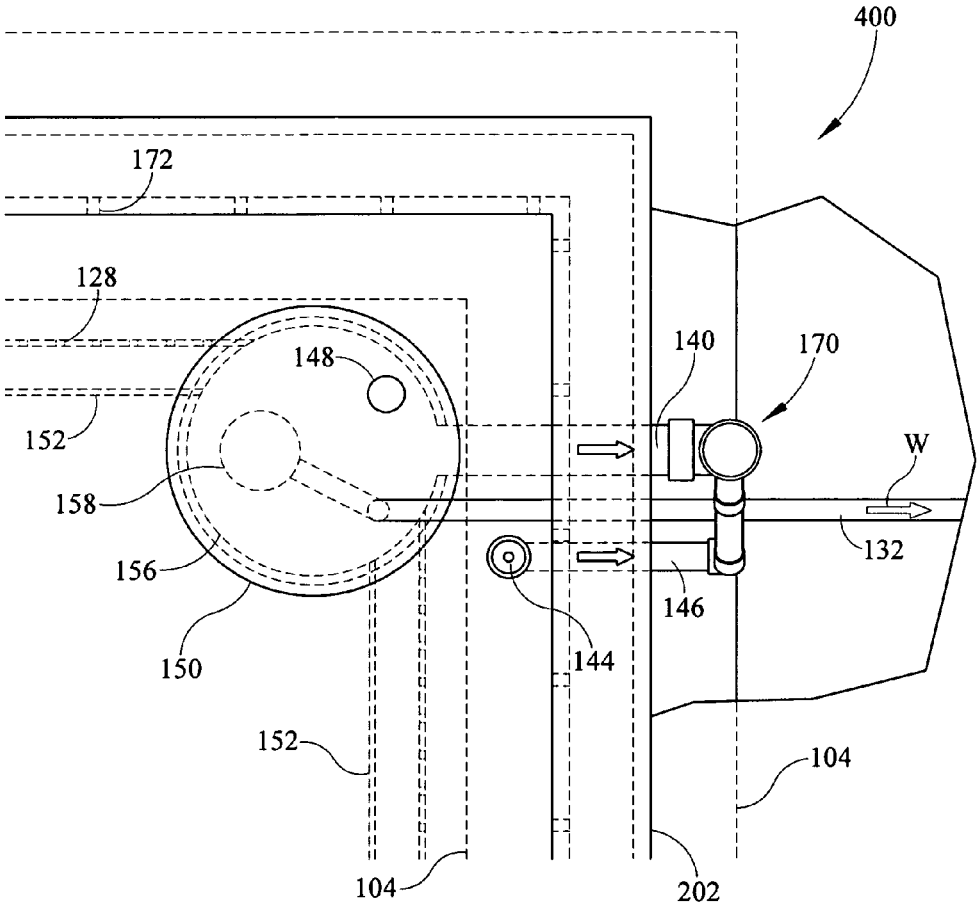
FIG. 4 is a top detailed view of an embodiment of the sump, water and air pipes of a ventilation system for an existing structure having a crawlspace.

FIG. 4 shows a top detailed view of crawlspace ventilation system 400 designed for an existing structure having a crawlspace. Crawlspace wall 202 rests on footer 104 and extends upward therefrom. Submersible sump pump 158 rests in a bottom portion of sump liner 156 and has suction tube assembly 170 in flow communication therewith. Sump pump 158 pumps water 'W' collected within sump liner 156 upward and outward away from the structure through water discharge pipe 132. Sump liner 156 has sump cover 150 with view port 148 sealing the top opening thereof. Channel 152 having holes 128 in flow communication with weep holes 172 circumscribes the internal side of crawlspace wall 202 and connects into an upper portion of sump liner 156 thus keeping sump liner 156 and the internal portion of wall 202 under negative pressure. Suction tube assembly 170 joins into an upper portion of sump liner 156 and has air intake vent 144 joined thereto with air intake vent pipe 146 keeping the crawlspace under negative pressure. In this embodiment, air intake vent pipe 146 passes through exterior wall 172 prior becoming into flow communication with suction tube assembly 170 at suction tube 140. FIG. 4B is a top detailed view of an embodiment of the sump, water and air pipes of a ventilation system for an existing structure having a crawlspace.

Figure 5:
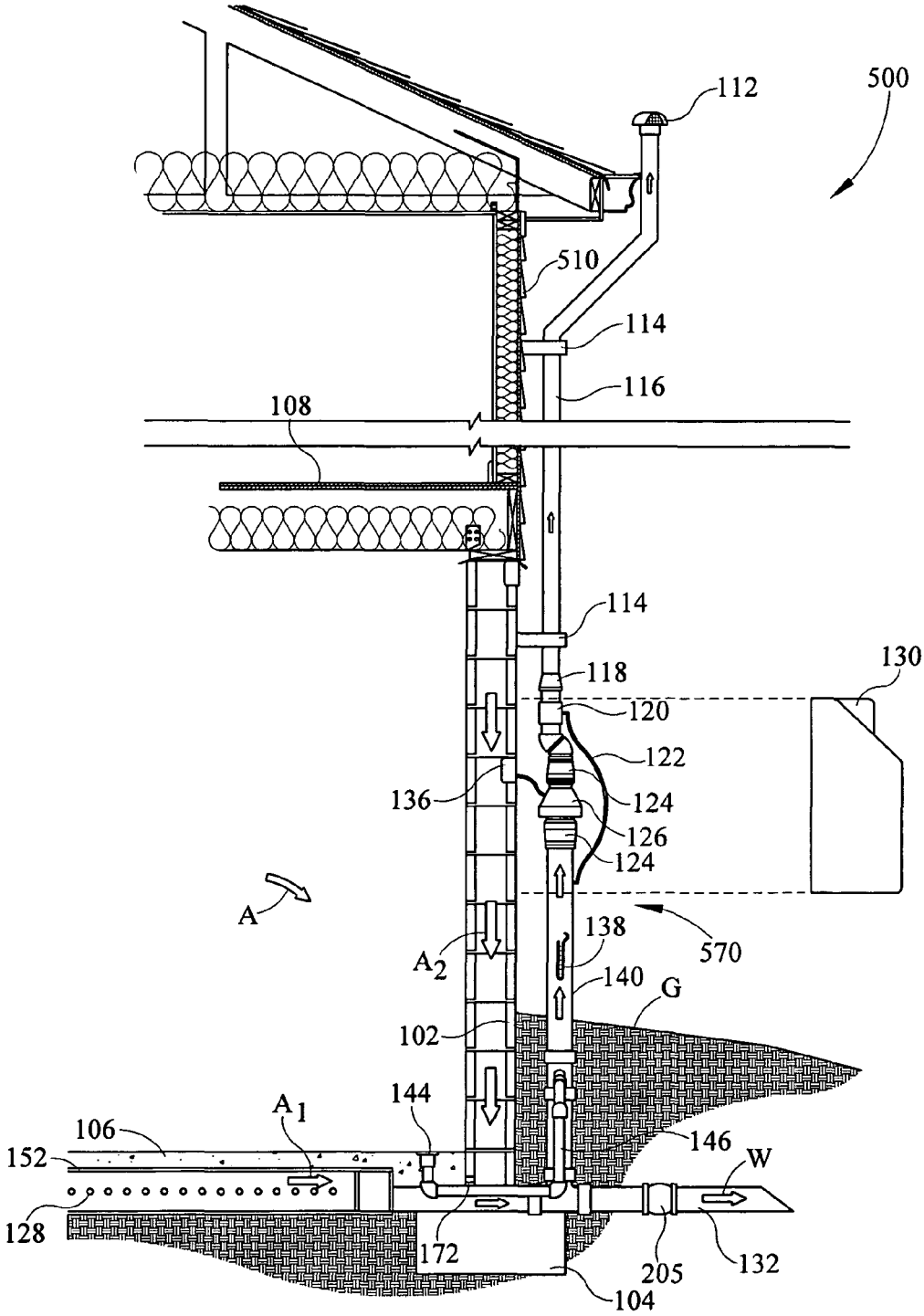
FIG. 5 is a cross-sectional view of an embodiment of a ventilation system for new construction of a structure having a daylight basement with gravity flow.

FIG. 5 shows an embodiment of a ventilation system 500 for new construction of a structure having a daylight basement with gravity flow. Basement wall 102 rests on footer 104 and extends upward supporting the first floor 108 of the structure. Water discharge pipe 132 having check valve 205 extends outward away from the structure. Channel 152 having holes 128 circumscribes the internal side of basement wall 102 below basement slab 106. Suction tube 140 is a lower part of suction tube assembly 270 and is maintained under negative pressure with exhaust fan 126. Suction tube 140 joins into channel 152 and has air intake vent 144 joined thereto with air intake vent pipe 146. Air intake vent 144 is substantially flush with basement slab 106 and provides for continuous ventilation, as shown with arrow 'A', of the daylight basement keeping the daylight basement under negative pressure. Channel 152 pulls air '$A_1$' through holes 128 into channel 152, creating negative pressure within channels 152 and about the perimeter of the structure. Channels 152 are in flow communication with the interior portion of basement wall 102 via weep holes 172 pulling air '$A_2$' therethrough and creating negative pressure within basement wall 102. Suction tube assembly 570 has manometer 138 monitoring the pressure differential between suction tube 140 and the ambient air providing an indicator of negative pressure. Suction tube assembly 570 passes through basement wall 102 and continues vertically upward where flexible couplings 124 join each end of exhaust fan 126 into suction tube assembly 270. Exhaust fan 126 is in electrical communication with electrical disconnect 136. Above exhaust fan 126 is optional condensation collar 120 having condensation tube 122 depending therefrom. Condensation tube 122 carries condensate flowing down tube assembly 570 into a lower portion of suction tube assembly 570 below exhaust fan 126 or suction tube 140. This condensate travels down suction tube 140 into water discharge pipe 132 as a part of water 'W'. Fan 126, flexible couplings 124, condensate collar 129, and condensation tube 122, are optionally housed within fan cover 130. Typically, suction tube assembly 570 is comprised of round PVC pipe below condensation collar 120. It may be advantageous for suction tube assembly 570 to be comprised of metal downspout above condensation collar 120. Therefore, optional PVC round to metal downspout adaptor 118 may be incorporated within suction tube assembly 570 wherein metal downspout 116 depends upward therefrom. Brackets 114 may be necessary to support suction tube assembly 570 to the exterior surface of structure 510. Suction tube assembly 570 terminates with exhaust vent 112 which preferably exhausts at an upper portion of the building.

Figure 6:
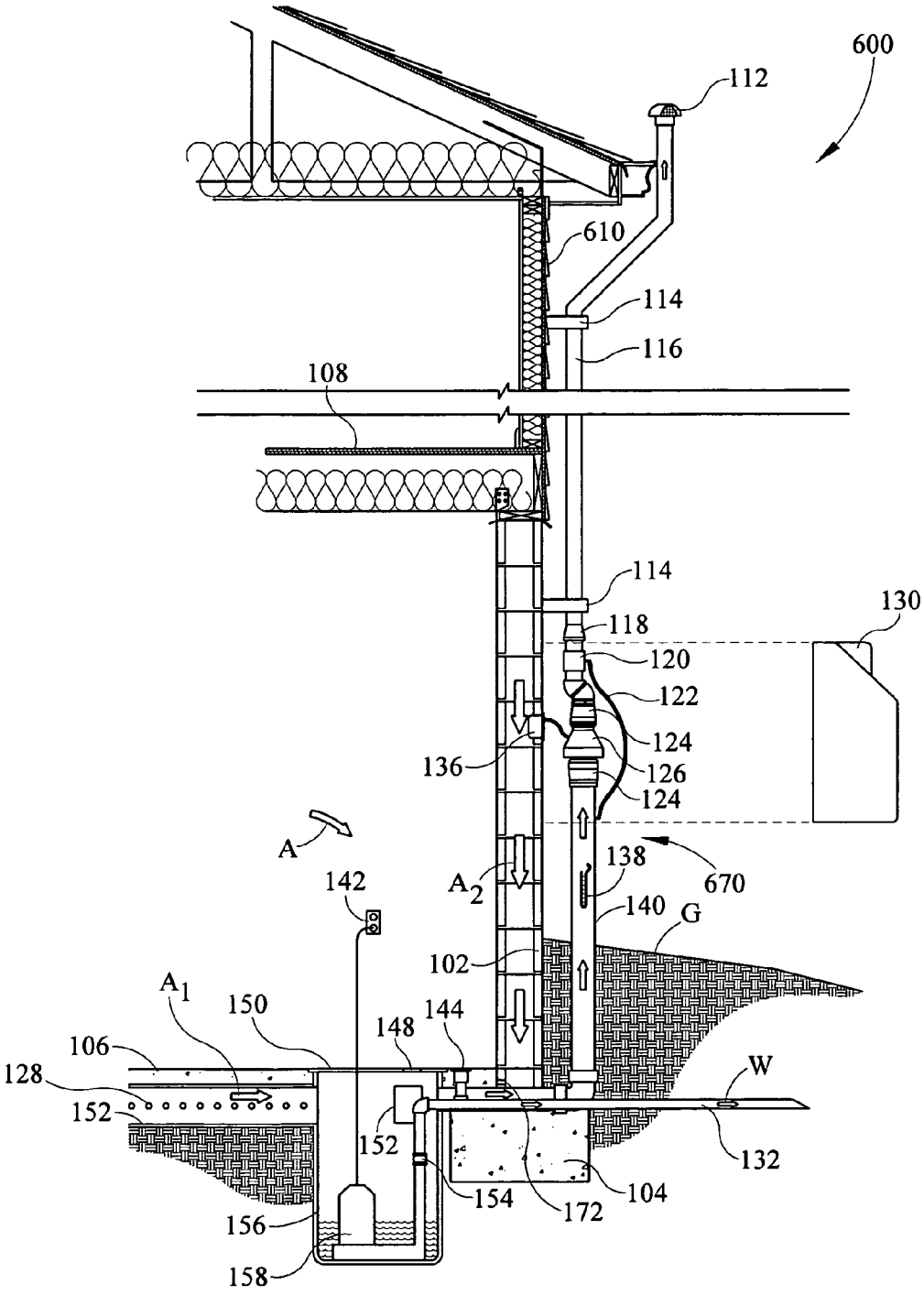
FIG. 6 is a cross-sectional view of an embodiment of a ventilation system for an existing structure having a daylight basement.

FIG. 6 shows ventilation system 600 designed for an existing structure having a daylight basement. Basement wall 102 rests on footer 104 and extends upward supporting the first floor 108 of the structure. Submersible sump pump 158 rests in a bottom portion of sump liner 156. Sump pump 158 pumps water 'W' collected within sump liner 156 upward and outward away from the structure through water discharge pipe 132 having check valve 154. Sump liner 156 has sump cover 150 with optional view port 148 sealing the top opening thereof and being substantially flush with basement slab 106. Channel 152 having holes 128 circumscribe the internal side of basement wall 102 below and proximate basement slab 106 and connect into an upper portion of sump liner 156. Sump pump 158 is in electrical communication with power supply 142. Suction tube 140 is a part of suction tube assembly 670 is maintained under negative pressure with exhaust fan 126. Suction tube 140 joins into an upper portion of sump liner 156 and has air intake vent 144 joined thereto with air intake vent pipe 146. Air intake vent 144 is substantially flush with basement slab 106 and provides for continuous ventilation, as shown with arrow 'A', of the daylight basement, keeping the daylight basement under negative pressure. The negative pressure created within sump liner 156 pulls air '$A_1$' through holes 128 into channel 152, creating negative pressure within channels 152. Channels 152 are in flow communication with the interior portion of daylight basement wall 102 via weep holes 172 pulling air '$A_2$' therethrough and creating negative pressure within basement wall 102. Any water or moisture that may enter channel 152 flows into sump liner 156 which is discharged form the structure as shown with 'W'. Suction tube assembly 670 optionally has manometer 138 monitoring the pressure differential between suction tube 140 and the outside ambient air providing an indicator of the pressure differential therebetween. Suction tube assembly 670 passes through basement wall 102 and continues vertically upward where flexible couplings 124 join each end of exhaust fan 126 into suction tube assembly 670. Exhaust fan 126 is in electrical communication with electrical disconnect 136. Above exhaust fan 126 is condensation collar 120 having condensation tube 122 depending therefrom. Condensation tube 122 carries condensate flowing down suction tube assembly 670 into suction tube 140 below exhaust fan 126. This condensate is carried down suction tube 140 into sump liner 156 where it is pumped out of the structure with water 'W'. Fan 126, flexible couplings 124, condensate collar 120, and condensation tube 122, are optionally housed within fan cover 130. Optional PVC round to metal downspout adaptor 118 may be incorporated within suction tube assembly 670 wherein a metal downspout 116 may depend upward therefrom. Brackets 114 may be necessary to support suction tube assembly 670 to the exterior surface of the building 610. Suction tube assembly 670 terminates with exhaust vent 112 which preferably exhausts at an upper portion of the building taking advantage of additional vacuum created within suction tube assembly 670 from outdoor air flowing thereby.

Figure 7:
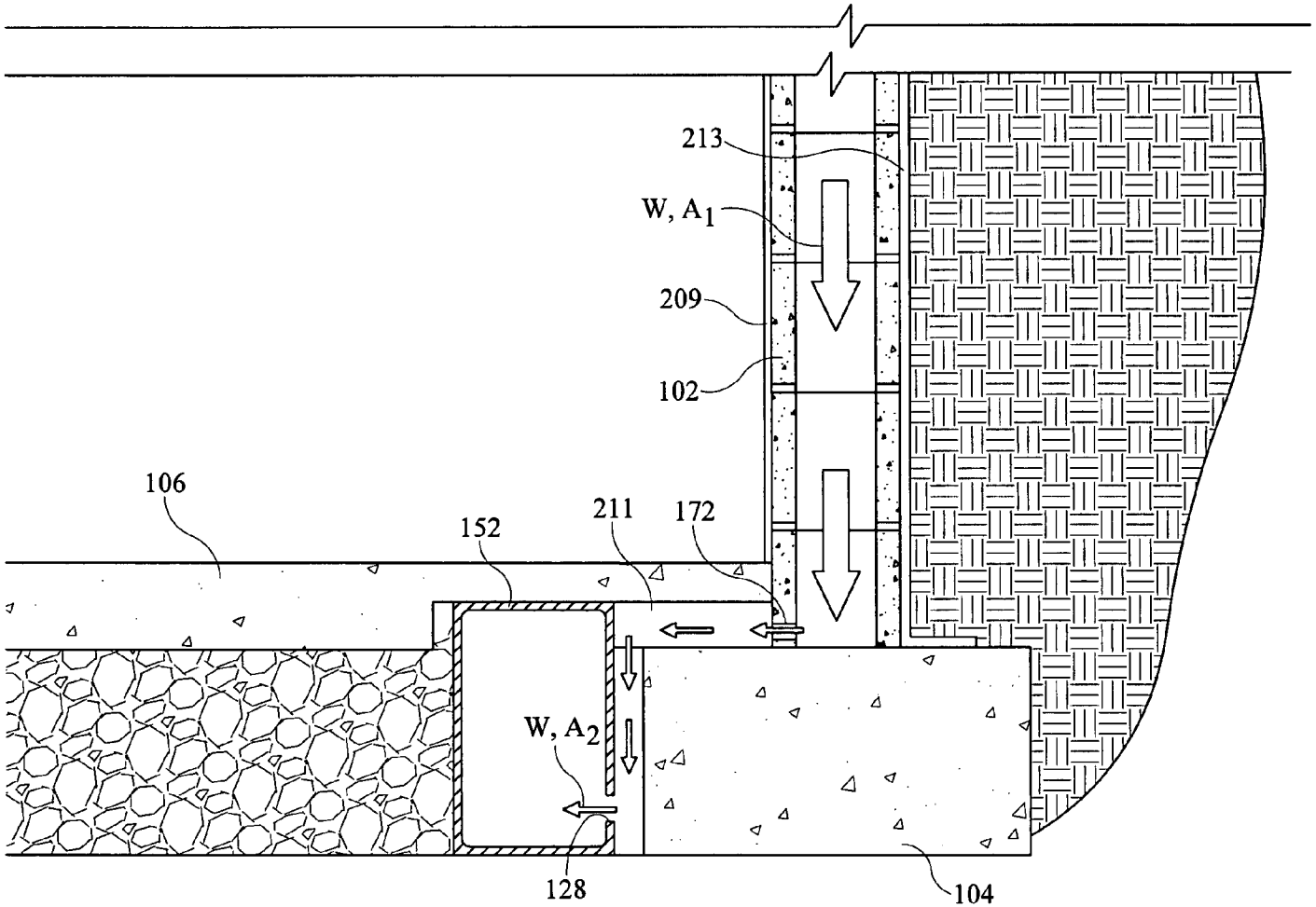
FIG. 7 is a cross-sectional view of air movement within the walls of the structure and through the ventilation system.

FIG. 7 shows the air movement within the walls of a structure and through the ventilation system. Channel 152 is located under slab 106 proximate exterior wall 102 and is in flow communication with an interior portion thereof. The negative pressure created within channel 152 pulls air '$A_1$' through weep holes 172 in exterior wall 102, between flow through support 211, and holes 128 into channel 152 joining air '$A_2$', creating negative pressure within channels 152 and the interior of exterior walls 102. Flow through support 211, in this embodiment, is shown as gap spaced support blocks where air $A_1$ passes between gaps positioned at weep holes 172. It is to be understood that flow through support 211 may be comprised of any material and have any configuration that supports slab 106 and provides for flow through of air $A_1$. Water 'W', gases, or moisture that may enter channel 152 is transported to the exterior of the structure. Also shown here are optional interior wall liner 209 and exterior seal 213.

Figure 8:
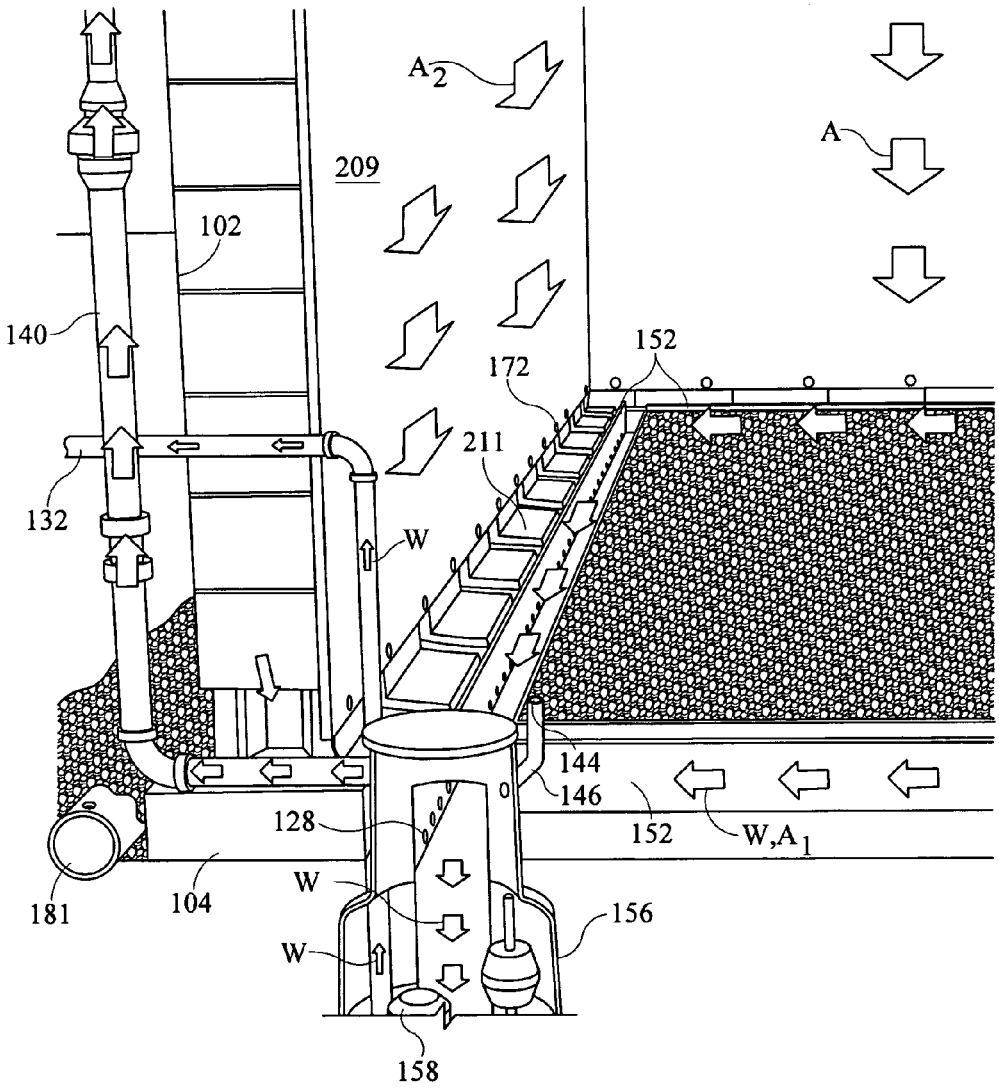
FIG. 8 is a perspective cut-away view of a section of a structure showing the ventilation system with water and air flow patterns.

FIG. 8 shows a structure having a sump pump 158 and depicting water and air flow patterns therewith. Suction tube 140 joins into an upper portion of sump liner 156 and has air intake vent 144 joined thereto with air intake vent pipe 146. Air intake vent 144 is substantially flush with a slab, not shown here, and provides for continuous ventilation, as shown with arrow 'A', of the lower portion of the structure, keeping the entire structure under negative pressure. The negative pressure created within sump liner 156 pulls air '$A_1$' through holes 128 into channel 152, creating negative pressure within channels 152. In this figure, channel 152 is shown without a top covering to show the path of $A_1$. It is to be understood that channels 152 have a top and can have most any cross-sectional configuration. Channels 152 are in flow communication with the interior portion of wall 102 via weep holes 172 pulling air '$A_2$' therethrough and creating negative pressure within wall 102. Water 'W', gases, or moisture that may enter channel 152 flows into sump liner 156. Water "W" within sump pump liner 156 is pumped to the exterior of the structure with sump pump 158 through water discharge pipe 132. Also shown here is optional interior wall liner 209 and drain pipe 181 which may be incorporated within a traditional french drain.

Figure 9:
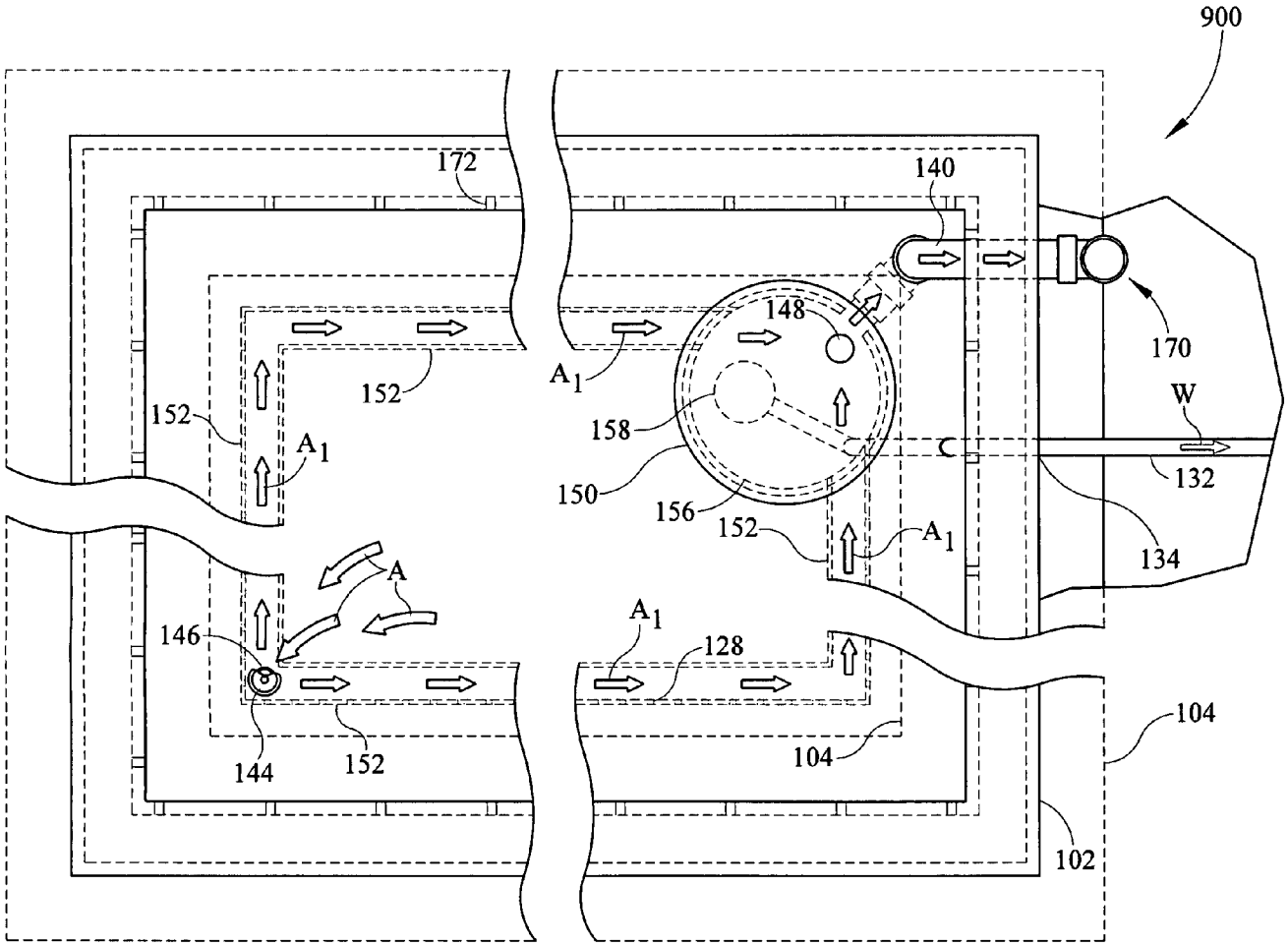
FIG. 9 shows a top detailed view of a ventilation system having an air intake vent substantially opposite a sump pump, continuously ventilating a negative pressure channel.

FIG. 9 shows a top detailed view of ventilation system 900 having intake vent 144 substantially opposite sump pump 158. In this embodiment, channel 152 is continuously ventilated. Wall 102 rests on footer 104 and extends upward therefrom. Submersible sump pump 158 rests in a bottom portion of sump liner 156 and has suction tube assembly 170 in flow communication therewith. Sump pump 158 pumps water 'W' collected within sump liner 156 and channel 152 upward and outward away from the structure through water discharge pipe 132. Water discharge pipe 132 is sealed where it passes through the exterior side of basement wall 102 with caulk 134. Sump liner 156 has sump cover 150 with view port 148 sealing the top opening thereof. Channel 152 having holes 128 in flow communication with weep holes 172 circumscribes the internal side of wall 102 and connects into an upper portion of sump liner 156 thus keeping sump liner 156 and the internal portion of wall 102 under negative pressure. Suction tube assembly 170 has suction tube 140 joining into an upper portion of sump liner 156. Air intake vent 144 is in flow communication with channel 152 via intake vent pipe 146 at a substantially furthermost point within channel 152 from a point where ends of channel 152 become in flow communication with sump pump liner 156. In this embodiment, air 'A' is drawn into channel 152 from a lower portion of the structure. Air 'A' continuously picks up gases and moisture within channel 152 as it is pulled to sump liner 156 as designated by '$A_1$'. At sump liner 156, Air '$A_1$' is exhausted from the structure through suction pipe 140.

Figure 10:
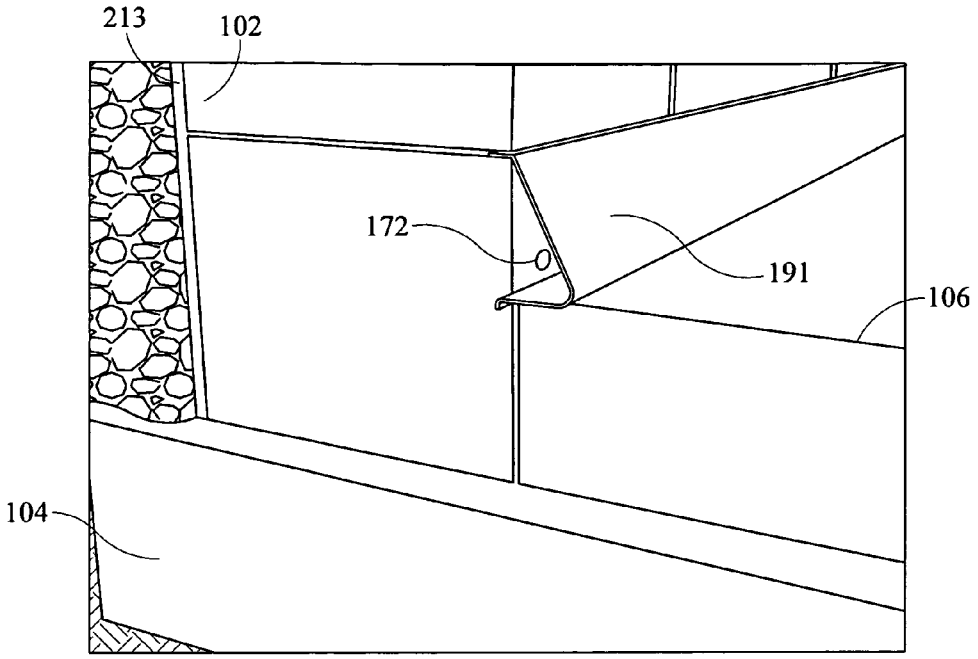
FIG. 10 shows an alternative embodiment and placement of a negative pressure channel.
Figure 11:
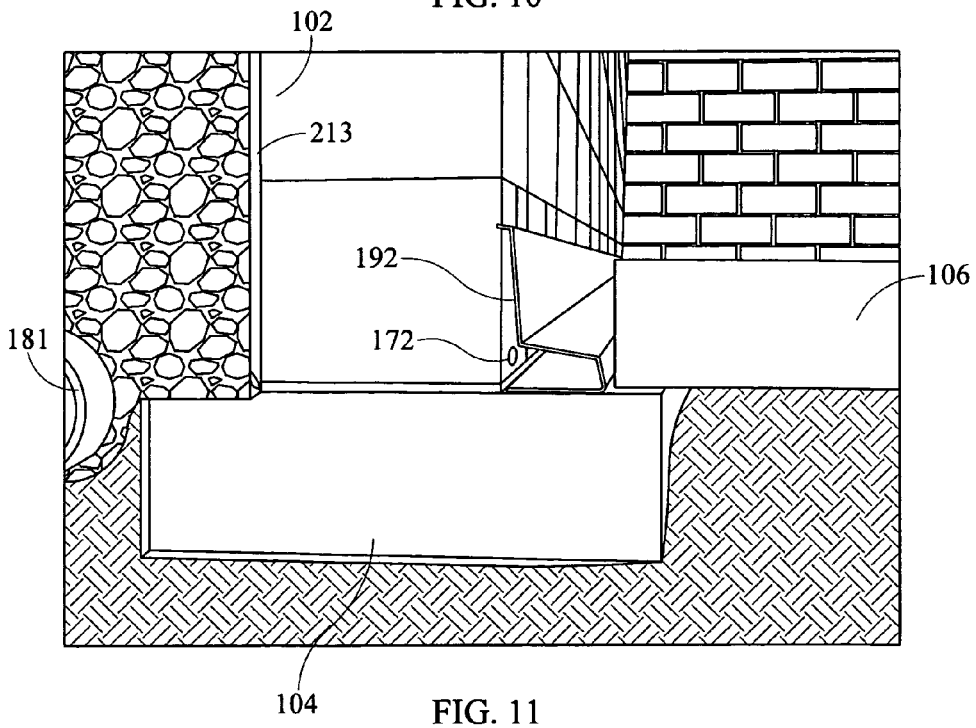
FIG. 11 shows another alternative embodiment and placement of a negative pressure channel.

FIGS. 10 and 11 show alternative embodiments of a channel 191 and 192. Channel 191 resides atop slab 106 and is sealed with wall 102 along a top and bottom edge about weep holes 172. Channel 191 provides for economical installation into a preexisting structure. Channel 192 resides atop footer 104 and has a portion within slab 106. Channel 192 is sealed about a top edge to wall 102 and about a bottom edge to footer 104 or wall 102 and has an open side about weep holes 172. Also shown is optional exterior seal 213 and optional drain pipe 181 (FIG. 11).

The invention claimed is:

1. A method for ventilating a building structure comprising the steps of:

creating a negative pressure within a channel, said channel being proximate an interior side of a footer of at least one exterior wall of said structure and having a plurality of apertures therein to depressurize an area beneath said structure;

creating a negative pressure within an interior of at least one exterior wall of said structure;

creating a negative pressure within an interior lower portion of said structure, said interior lower portion defined by one of a basement, a crawlspace and a lower floor, said interior lower portion being located within a perimeter defined by said at least one exterior wall and above a lower substrate of said building structure, said lower substrate defined by one of a concrete slab or a crawlspace vapor barrier;

providing substantially unobstructed airflow communication from said interior lower portion toward an exhaust fan through an air intake vent and an air intake vent pipe, said air intake vent pipe extending between said air intake vent and a suction tube in further flow communication with said exhaust fan for said creating said negative pressure wherein fresh air from said interior lower portion is pulled from said interior lower portion downwardly through said lower substrate through said air intake vent pipe and to said suction tube toward said exhaust fan;

exhausting at least one of vapor, gases and said fresh air collected in said channel, said at least one exterior wall, and said lower portion of said structure through said exhaust fan to the exterior of said structure.

2. The method for ventilating a structure of claim 1 wherein said channel, said at least one exterior wall of said structure, and said lower portion of said structure are each in flow communication with one another.

3. The method of ventilating a structure of claim 2 wherein said steps of creating a negative pressure within said channel, creating a negative pressure within at least one exterior wall of said structure, creating a negative pressure within said lower portion of said structure, and exhausting said at least one of vapor, gases and said fresh air are each achieved with said exhaust fan.

4. The method of ventilating a structure of claim 3 wherein said exhaust fan is in flow communication with a suction tube assembly having said suction tube including an inlet and an outlet, said inlet being created at a lower pressure than said outlet with said exhaust fan, said inlet being in flow communication with said at least one channel, said at least one exterior wall of said structure, and said interior lower portion of said structure, and said outlet exhausting said at least one of vapors, gases and said fresh air at an elevation above said at least one channel.

5. The method of ventilating a structure of claim 1 wherein said exhausting is completed at a rate of at least 6 times the volume of said structure per day.

6. The method of ventilating a structure of claim 1 wherein said exhausting is completed at a rate of approximately 10 times the volume of said structure per day.

7. The method of ventilating a structure of claim 1 wherein said structure has a sump and said method for ventilating a structure further comprises the step of creating a negative pressure within said sump.

8. The method of ventilating a structure of claim 4 wherein said suction tube assembly has a condensation bypass collar and said method for ventilating a structure further comprises the step of diverting liquids flowing down said suction tube assembly away from said exhaust fan.

9. The method of ventilating a structure of claim 4 further comprising the step of monitoring a pressure differential between said suction tube and outside ambient air.

10. The method of ventilating a structure of claim 1 further comprising the step of creating a negative pressure within a portion of said structure having an elevation above said lower portion of said structure, said portion of said structure having an elevation above said lower portion of said structure being in flow communication with said lower portion of said structure.

11. The method of ventilating a structure of claim 1 wherein said step of creating a negative pressure within at least one exterior wall of said structure comprises creating a vacuum within each exterior wall of said structure.

12. The method of ventilating a structure of claim 1 further comprising the step of creating a negative pressure within soil proximate a foundation of said structure.

13. The method of ventilating a structure of claim 1 further comprising the step of removing liquids entering said plurality of apertures in said channel from said channel.

14. The method of ventilating a structure of claim 1 wherein said steps of creating a vacuum within a channel disposed adjacent an interior surface of at least one exterior wall, creating said vacuum within said at least one exterior wall, creating a negative pressure within an interior lower portion of said structure, and exhausting said at least one vapor, gases and said fresh air each simultaneously and for a desired period of time with at least one fan in electrical communication with a control unit, said control unit being in electrical communication with at least one humidity sensor and being suitable for switching said fan on and off in response to set parameters.

* * * * *